United States Patent [19]

Schmid et al.

[11] 4,280,572

[45] Jul. 28, 1981

[54] CHISEL FOR A PERCUSSIVE TOOL

[75] Inventors: Leo Schmid; Heinrich Kotyza, both of Salzgitter, Fed. Rep. of Germany

[73] Assignee: Salzgitter Maschinen und Anlagen Aktiengesellschaft, Salzgitter, Fed. Rep. of Germany

[21] Appl. No.: 18,671

[22] Filed: Mar. 8, 1979

[30] Foreign Application Priority Data

Mar. 11, 1978 [DE] Fed. Rep. of Germany ..... 2810606

[51] Int. Cl.[3] ..... E21B 10/36

[52] U.S. Cl. ..... 175/417; 175/393; 175/418; 239/589

[58] Field of Search ..... 175/67, 339, 340, 393, 175/417, 418, 414, 422, 409, 410; 299/17, 81; 239/565, 589, 600, 602

[56] References Cited

U.S. PATENT DOCUMENTS

| | | | |
|---|---|---|---|
| 604,538 | 5/1898 | Leyner | 175/393 |
| 1,081,721 | 12/1913 | Carr | 175/417 |
| 1,355,793 | 10/1920 | Bernay | 175/419 |
| 1,697,570 | 1/1929 | Mecom | 175/418 X |
| 1,950,513 | 3/1934 | Pope | 175/417 |
| 2,003,144 | 5/1935 | Graham, Jr. | 175/418 X |
| 2,069,482 | 2/1937 | Seay | 175/393 X |
| 2,131,056 | 9/1938 | Lind | 175/417 X |
| 2,161,062 | 6/1939 | Killgore | 175/410 X |
| 3,554,306 | 1/1971 | Wilburn | 175/417 X |
| 3,554,602 | 1/1971 | Chaney | 175/67 X |
| 3,841,559 | 10/1974 | Hall et al. | 175/422 X |
| 4,022,287 | 5/1977 | Lundstrom et al. | 175/393 |

FOREIGN PATENT DOCUMENTS

| | | | |
|---|---|---|---|
| 647736 | 12/1950 | United Kingdom | 175/409 |

*Primary Examiner*—Ernest R. Purser
*Assistant Examiner*—Richard E. Favreau
*Attorney, Agent, or Firm*—Michael J. Striker

[57] ABSTRACT

A percussive tool, particularly a chisel for percussive working in rock, has a body portion, and a nozzle arrangement in the body portion, which is operative for forming a high-speed flow of a high-pressure fluid, particularly liquid, and directing the same to a working region of the body portion. The nozzle arrangement may include a plurality of nozzle holes which are open into the working region. It may also include at least one nozzle hole and at least one nozzle directing the flow of fluid into the nozzle hole. The nozzle may be supported by a supporting member which has an inner passage and extends from an inner chamber of a head section of the body portion into a receiving recess of a shaft section of the latter. The supporting member may be adjustable in the direction of a longitudinal axis of the chisel.

18 Claims, 13 Drawing Figures

FIG. 11
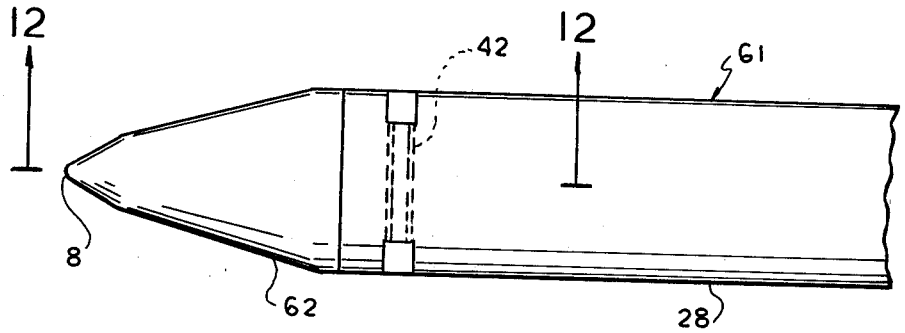
FIG. 12
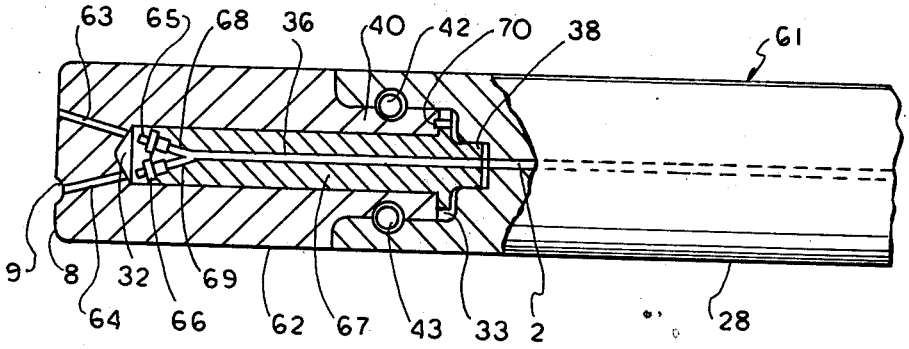
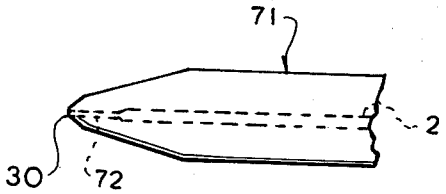
FIG. 13

CHISEL FOR A PERCUSSIVE TOOL

BACKGROUND OF THE INVENTION

The present invention relates to a chisel for a tool which acts upon rock with percussive action.

During mining, particularly of homogenous formations, with the use of conventional chisels and hydraulic hammers, the striking action and thereby the operating efficiency are not satisfactory. In the working zone of the chisel, a dust cushion is frequently formed, which decreases the striking force and simultaneously leads to a dust explosion. The compressed dust promptly escapes laterally of the chisel, and the expansion of dust negatively affects the environmental conditions. This known method of operation is not only economically inefficient but also hinders the visibility and is hazardous for the operational personnel.

SUMMARY OF THE INVENTION

Accordingly, it is an object of the present invention to provide a chisel for a percussion tool, which avoids the disadvantages of the prior art.

More particularly, it is an object of the present invention to provide a chisel for a percussive tool, particularly for working in homogenous rock, which improves output, increases operational safety, and reduces environmental pollution.

In keeping with these objects, and with others which will become apparent hereinafter, one feature of the present invention resides, briefly stated, in a chisel provided with nozzle means which is operative for forming a high-speed flow of a high-pressure fluid, particularly liquid, and directing the same to a working region of the chisel.

During the striking operation of the chisel, microcracks are formed in rock. The liquid, particularly water, penetrates into these microcracks and during deeper penetration of the chisel into homogenous rock in the conditions of the consecutive strikes, the liquid is alternately subjected to pressure. This leads to a hydraulic splitting of rock. The homogenous rock is loosened under the alternating action of the strike and the high-speed flow of liquid. The rock particles are washed away from the working zone by the out-flowing liquid. The above-mentioned formation of disadvantageous dust cushions is also prevented. Instead, the striking energy of the tool can be converted into effective strikes of the chisel upon the hard rock. The binding of the rock dust by the out-flowing liquid effectively helps to cause favorable environmental conditions in situ, improves the visibility, and spares the operating personnel. Additional spraying of the working zone for settling of the rock dust can be dispensed with. The mining output or advancement output of the tool equipped with the inventive chisel is considerably increased. The parameters and thereby the action of the high-speed flow of liquid can be selected in optimum manner in dependence upon the type and hardness of rock. The striking work required for removing a given volume of rock is smaller and the service-life of the tool increases so that the operational expenditures decrease.

In accordance with another feature of the present invention, the high-speed flow of the high-pressure liquid flows through one section of the chisel and supplies the nozzle means formed in a body portion of the chisel. Thus, the chisel itself is utilized as a part of the system for supplying the high-pressure liquid.

Still another feature of the present invention is that, when the chisel is a pointed chisel, the nozzle device has a nozzle hole which directs the flow of liquid to a tip of the body portion of the chisel. Such a chisel is very inexpensive, and at the same time is highly effective.

A further feature of the present invention is that, when the chisel is a flat chisel, the nozzle means has at least one nozzle opening which is open at a cutting edge of the flat chisel. Here again, the chisel is inexpensive and at the same time very effective.

Advantageously, the nozzle means has a plurality of nozzle holes which communicate with a supply conduit.

When the rock to be worked out has a tendency to clog the nozzle hole, an extension may be provided in the cutting edge of the chisel, and the nozzle hole may open into this extension.

In accordance with yet another feature of the present invention, a flat chisel according to the invention has a recess in the region of the cutting edge, and at least one nozzle connected with a supply conduit is located in this recess. The extent of the dynamic breakage of the rock by the flow of liquid depends, inter alia, upon the distance from the nozzle to the rock. The recess provides for the necessary distance.

It is advantageous that the distance between at least one nozzle and the cutting edge of the chisel can be adjusted in dependence upon differing types and hardnesses of various rocks.

A further feature of the present invention is that the chisel has a shaft section which is connected with a head section having an inner chamber wherein the nozzle is accommodated so as to direct the flow of liquid into the nozzle hole. The subdivision of the chisel into two parts makes it possible to interchange the head sections in dependence upon the materials to be worked. The head section can be formed as a point chisel, flat chisel, spade chisel or pyramidal chisel, and utilized in an optimum manner. In all cases, the nozzle is located and protected in the inner chamber, and thereby after admitting the flow of fluid it can fully execute its action, inasmuch as the high-speed flow after passing the nozzle hole is still sufficiently concentrated and compact.

An additional feature of the present invention is that the nozzle may be mounted on a movable supporting member located in the inner chamber. The supporting member extends into a receiving recess of the shaft section and is sealed with reference to an inner wall of the receiving recess.

In order to attain an optimum matching to the rock to be worked on, the supporting member may be adjustable in the inner chamber of the head section and the receiving recess of the shaft section in the direction of the longitudinal axis of at least one nozzle. This adjustment may be performed by provision of a plurality of annular grooves on the supporting member and insertion of a fixing ring into a respective one of the annular grooves so as to abut against an end face of the head section.

The head section of the chisel may have an extension which is received in an opening of the shaft section and fixed in the latter by a tightening pin extending in a direction transverse to the longitudinal axis of the chisel. Thereby, fast and reliable connection between the head section and the shaft section of the chisel is guaranteed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 11 is a side view of a subdivided chisel in accordance with a still further embodiment of the present invention;

FIG. 12 is a plan view of the flat chisel shown in FIG. 11 which is partially sectioned along line 12—12; and FIG. 13 is a partial side view of a point chisel in accordance with an additional embodiment of the present invention.

DESCRIPTION OF THE PREFERRED EMBODIMENTS

Figure 1:
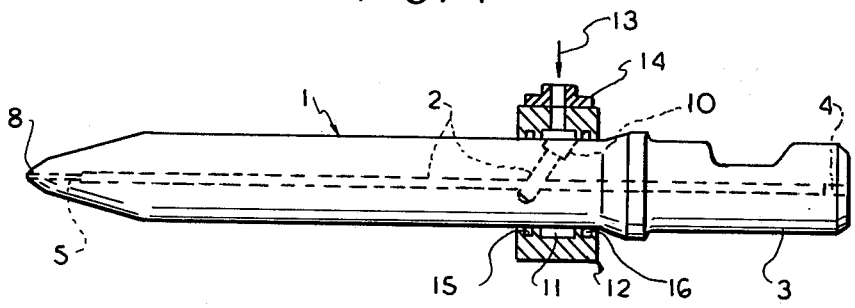
FIG. 1 is a side view of a flat chisel.

FIG. 1 depicts a flat chisel 1 which has a supply passage 2 for a high-pressure liquid, for example high-pressure water. The supply passage extends substantially in the direction of a longitudinal axis of the flat chisel 1. The supply passage 2 is closed by a plug 4 in a shank 3 and communicates with nozzle holes 5, 6 and 7 of a smaller diameter at the opposite end of the flat chisel 1. The nozzle holes 5 and 7 are open directly at a cutting edge 8. The nozzle hole 6 may also be open at the cutting edge 8. However, in accordance with the embodiment shown in FIG. 2, the nozzle hole 6 is open in an extension 9 provided in the cutting edge 8.

Figure 2:
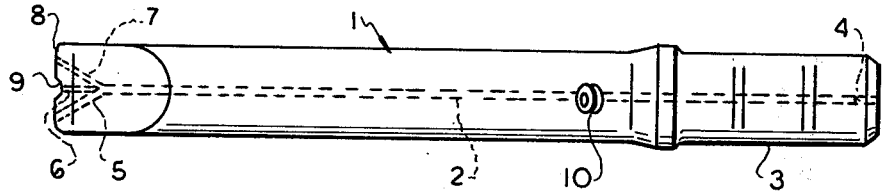
FIG. 2 is a plan view of the chisel shown in FIG. 1.

A small distance forwardly of the rear end of shank 3 the supply passage 2 has a section 10 which is inclined to the longitudinal axis of the flat chisel 1. The inclined section 10 pierces the outer surface of the flat chisel 1 and communicates with an annular groove 11 of a supply ring 12 for the high-pressure liquid. The high-pressure liquid flows in the direction of an arrow 13 through an end flange 14 into the annular groove 11 and is prevented from lateral leakage by lateral sealing rings 15 and 16. In FIG. 2 the supply ring 12 is omitted for the sake of clarity.

Figure 3:
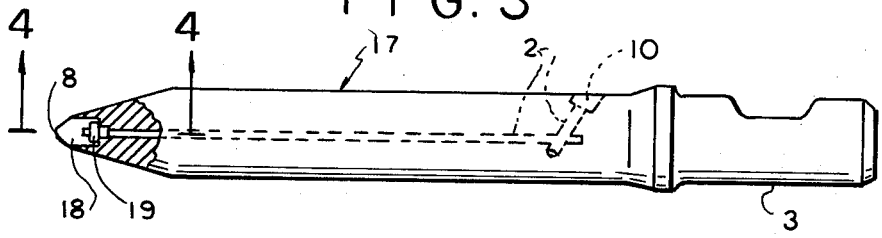
FIG. 3 is a side view of a flat chisel in accordance with another embodiment of the present invention, taken along line 3—3 in FIG. 4.
Figure 4:
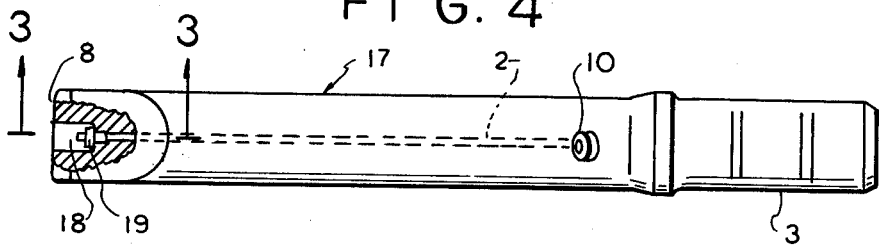
FIG. 4 is a plan view of the chisel shown in FIG. 3, which is partially sectioned along line 4—4 in FIG. 3.

FIGS. 3 and 4 show a flat chisel 17 wherein the parts identical to those of FIGS. 1 and 2 are identified by identical reference numerals. The cutting edge 8 has a central recess 18, and the supply passage 2 extends from a rear wall bounding the recess 18 in direction of the longitudinal axis of the flat chisel 17 so as to merge into the inclined section 10. A wall bounding a front end portion of the supply passage 2 is provided with a thread, and a nozzle 19 is screwed into the latter. The nozzle 19 directs the high-speed flow of the high-pressure liquid toward the cutting edge 8 of the flat chisel.

Figure 5:
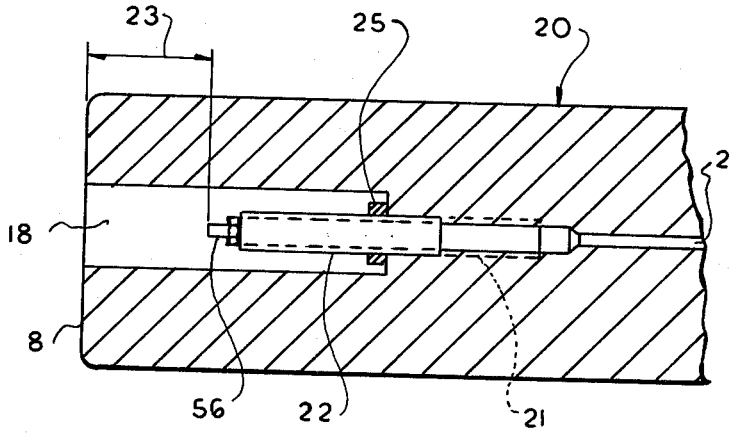
FIG. 5 is a partial section of a flat chisel in accordance with still another embodiment of the present invention.

FIG. 5 shows another flat chisel 20, wherein again the parts identical to those of the above-described chisels are identified by identical reference numerals. The recess 18 here extends relatively deeply in the direction of the longitudinal axis of the flat chisel 20. A thread 21 in the wall of the front portion of the supply passage 2 is relatively long. A supporting member 22, which supports a nozzle 56 and is adjustable in the axial direction, is screwed in the thus-threaded wall. By screwing in or screwing out the supporting member 22, the distance 23 between the cutting edge 8 and the nozzle 56 can be adjusted in an optimum manner for optimum operation of the nozzle 56. In the respective optimum location the supporting member 22 is fixed by a counter nut 25.

Figure 6:
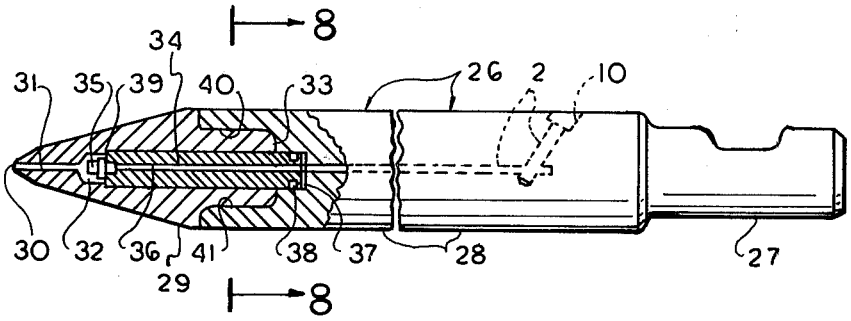
FIG. 6 is a side view of a point chisel which is subdivided into two parts, partially sectioned along line 6—6 in FIG. 7.
Figure 7:
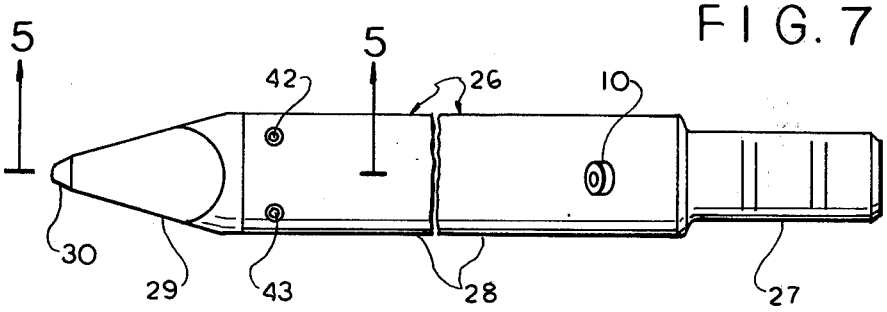
FIG. 7 is a plan view of the point chisel shown in FIG. 6.
Figure 8:
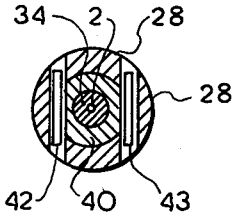
FIG. 8 is a section taken along line VIII—VIII in FIG. 6.

FIGS. 6, 7 and 8 show a point chisel 26 which is subdivided into a shaft section 28 in the region of a shank 27 and a head section 29 connected with the shaft section 28. The head section 29 is formed as a pyramidal head having a chisel tip 30. A nozzle hole 31 is provided in the head section 29 and extends in the direction of a longitudinal axis of the latter. The nozzle hole 31 merges into a wider inner chamber 32. A supporting member 34 for supporting a nozzle 35 extends from a rear end portion 33 of the head section 29 into the inner chamber 32. The nozzle 35 is screwed on a front end portion of the supporting member 34. A hole in a longitudinal axis of the nozzle 35 is in alignment with the nozzle hole 31. The nozzle 35 is supplied with the high-pressure liquid from the supply passage 2 through a passage 36 in the supporting member 34.

The other end of the supporting member 34 extends into a recess 37 of the shaft section 28 and is sealed against an inner wall of the recess 37 by a sealing ring 38. The rear end portion of the supporting member 34, which is located in the recess 37 is subjected to the action of the high-pressure liquid. Thereby, the supporting member 34 in FIG. 6 is pressed to the left to a firm and predetermined abutment against a shoulder 39 of the inner chamber 32. The head section 29 engages, with its extension 40, in an opening 41 of the shaft section 28 and is fixed to the latter by pins 42 and 43. The latter extend in a direction transverse to the longitudinal axis of the point chisel 26, as shown particularly in FIG. 8.

Figure 9:
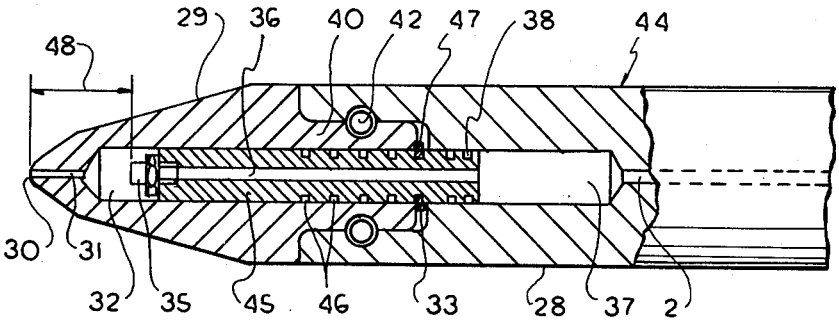
FIG. 9 is a partial longitudinal section of a point chisel in accordance with another embodiment of the invention.

In the following Figures the parts identical to those of the chisels shown in the previous Figures are again identified by identical reference numerals. In FIG. 9 a point chisel is shown which is subdivided into two parts in a different manner and has an axially adjustable supporting member 45. For the purposes of adjustment, a plurality of annular grooves 46 are provided on the outer surface of the supporting member 45 and spaced from one another in the axial direction. A securing ring 47 can be inserted in any of these annular grooves 46 and abut against the rear end portion 33 of the head section 29. In such a construction, the distance 48 between the chisel tip 30 and the nozzle 35 can be adjusted in order to attain an optimum output. The recess 37 is therefore formed relatively deep.

Figure 10:
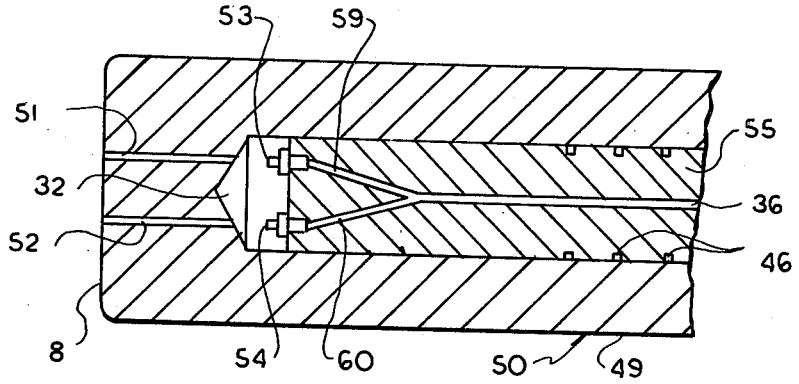
FIG. 10 is a partial longitudinal section of a flat chisel in accordance with a further embodiment of the present invention.

FIG. 10 depicts a part of a head section 49 of a subdivided flat chisel 50 whose shaft section corresponds to the shaft section 28 of FIG. 9 and, therefore, is not shown in FIG. 10. Two nozzle holes 51 and 52 extend parallel to one another and to the longitudinal axis of the flat chisel 50 from the inner chamber 32, and are open at the cutting edge 8. Nozzles 53 and 54 are in axial alignment with the nozzle holes 51 and 52 and are screwed in a threaded hole of an axially adjustable supporting member 55 which corresponds to the supporting member 45. Supply passages 59 and 60 for the nozzles 53 and 54 are supplied with the high-pressure liquid from the passage 36 of the supporting member 55.

FIGS. 11 and 12 show a subdivided flat chisel 61 whose shaft section 28 is connected with a head section 62. Nozzle holes 63 and 64 extend in this case from the inner chamber 32 at an angle to the longitudinal axis of the flat chisel 61 and are open at the cutting edge 8. The nozzle hole 64 is open indirectly into the extension 9, similarly to the nozzle hole 9 of FIG. 2.

Nozzles 65 and 66 are screwed in holes of a supporting member 67 and located in axial alignment with the nozzle holes 63 and 64. The passage 36 of the supporting member 67 communicates in this case with the nozzle 65 and 66 through branching holes 68 and 69. A pin 70 is inserted into the rear end portion 33 of the extension 40 of the head section and prevents relative movement between the supporting member 67 and the head section 62. Thereby continuous alignment of the nozzles 65 and 66 with the nozzle holes 63 and 64 is guaranteed.

FIG. 13 shows a point chisel 71 having a chisel tip 30 at which a nozzle hole 72 communicating with the supply passage 2, opens to emit the high-pressure liquid.

It will be understood that each of the elements described above, or two or more together, may also find a useful application in other types of constructions differing from the types described above.

While the invention has been illustrated and described as embodied in a chisel for a percussive tool, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A chisel for a percussive tool, particularly for percussive mining of rock, comprising a body portion having a working region; and at least one nozzle mounted in a chamber of said body portion and operative for forming a high-speed flow of a high-pressure fluid, particularly of a high-pressure liquid, and directing said fluid toward said working region, wherein said body portion has a head section and a shaft section connectable with one another, said chamber being arranged in said head section, and having at least one nozzle hole formed in said head section and communicating with said chamber and with said working region, and said at least one nozzle being arranged for directing the flow of fluid into said at least one nozzle hole.

2. A chisel as defined in claim 1, wherein said at least one nozzle is coaxial with said at least one nozzle hole.

3. A chisel as defined in claim 1, wherein said body portion has a section, said flow of fluid passing through said section of said body portion and supplying said at least one nozzle.

4. A chisel as defined in claim 1, wherein said chisel is a point chisel and said body portion has a tip forming said working region, said nozzle hole directing the fluid to said tip of said body portion.

5. A chisel as defined in claim 1, wherein said chisel is a flat chisel, said body portion having a cutting edge and a recess in said cutting edge, said at least one nozzle is being located in said recess.

6. A chisel as defined in claim 1, wherein said chisel is a flat chisel, said body portion being provided with a cutting edge, said nozzle means nozzle hole being open at said cutting edge.

7. A chisel as defined in claim 6, wherein said body portion has a supply passage formed therein, for supplying the fluid to said at least one nozzle.

8. A chisel as defined in claim 1, wherein said shaft section has an opening, said head section having a projection which is received in said opening and connected with said shaft portion.

9. A chisel as defined in claim 8, and further comprising connecting means for connecting said projection of said head portion with said shaft portion and including at least one pin engageable in the former and in the latter.

10. A chisel as defined in claim 1, including a supporting member arranged for supporting said at least one nozzle, said supporting member being inserted in said chamber of said head section and provided with an inner passage communicating with said at least one nozzle.

11. A chisel as defined in claim 10, wherein said shaft section of said body portion has a supply passage for supplying the fluid to said at least one nozzle and a receiving recess communicating with said supply passage and with said inner passage, and supporting member extending into said receiving recess of said shaft member and being sealed with respect to the latter.

12. A chisel as defined in claim 11, wherein said receiving recess is bounded by a wall; and further comprising sealing means located between said supporting member and said wall of said receiving recess.

13. A chisel as defined in claim 11, wherein said at least one nozzle has a longitudinal axis, said supporting member being adjustable in said chamber of said head section and in said receiving recess of said shaft section, in the direction of said longitudinal axis.

14. A chisel as defined in claim 11 wherein said supporting member has a longitudinal axis and is adjustable in said chamber of said head section and in said chamber of said head section and in said receiving recess of said shaft section, in the direction of said longitudinal axis.

15. A chisel as defined in claim 14, wherein said supporting member is elongated and provided with a plurality of annular grooves spaced from one another in the direction of said longitudinal axis; and further comprising adjusting means for adjusting said supporting member and including a ring engageable in any of said annular grooves and abutting against a wall of said head section so as to fix said supporting member in a respective position in the direction of said longitudinal axis.

16. A chisel for a percussive tool, particularly a flat chisel for percussive mining of rock, comprising a body portion having a working region and provided with a cutting edge and a supply passage; and at least one nozzle means in a chamber of said body portion and operative for forming a high-speed flow of a high-pressure fluid, particularly of a high-pressure liquid, and directing the same to said working region, said supply passage of said body portion being arranged for supplying the fluid to said nozzle, said nozzle including a plurality of nozzle holes which communicate with said supply passage of said body portion, at least one of said nozzle holes being open at said cutting edge.

17. A chisel as defined in claim 16, wherein said one nozzle hole has an extension portion at said cutting edge.

18. A chisel for a percussive tool, particularly for percussive mining of rock, comprising a body portion having a working region; at least one nozzle in a chamber of said body portion and operative for forming high-speed flow of a high pressure fluid, particularly of a high-pressure liquid, and directing the same to said working region; and means for adjusting the distance between said at least one nozzle and said working region.

* * * * *